United States Patent [19]

Lowe

[11] 4,137,187

[45] Jan. 30, 1979

[54] ANTIWEAR ADDITIVE AND LUBRICATING OIL COMPOSITION CONTAINING SAME

[75] Inventor: Warren Lowe, El Cerrito, Calif.

[73] Assignee: Chevron Research Company, San Francisco, Calif.

[21] Appl. No.: 823,313

[22] Filed: Aug. 10, 1977

[51] Int. Cl.[2] ..... C10M 1/48

[52] U.S. Cl. ..... 252/46.6; 252/49.9

[58] Field of Search ..... 252/46.6, 49.9; 260/125

[56] References Cited

U.S. PATENT DOCUMENTS

| | | | |
|---|---|---|---|
| 2,172,285 | 9/1939 | Lincoln et al. | 252/48.6 X |
| 2,459,718 | 1/1949 | Barnum et al. | 252/48.6 |
| 3,398,095 | 8/1968 | Judd | 252/48.6 X |
| 3,697,427 | 10/1972 | Byford et al. | 252/49.9 |

FOREIGN PATENT DOCUMENTS

| | | | |
|---|---|---|---|
| 496688 | 10/1953 | Canada | 252/48.6 |

*Primary Examiner*—Delbert E. Gantz

*Assistant Examiner*—Andrew Metz

*Attorney, Agent, or Firm*—C. J. Tonkin; L. L. Vaughan

[57] ABSTRACT

An anti-wear additive for lubricating compositions comprising (A) 1 part by weight of a sulfurized acid prepared by sulfurizing an acid of the formula R-COOH wherein R is $C_{10}$–$C_{40}$ alkenyl, said sulfurized acid having a minimum sulfur content of 3% by weight and (B) 1-100 parts by weight of a phosphate of the formula

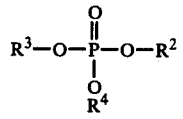

wherein each of $R^2$, $R^3$, and $R^4$ is independently a $C_6$–$C_{20}$ aromatic or $C_1$–$C_{20}$ aliphatic hydrocarbon group.

11 Claims, No Drawings

ANTIWEAR ADDITIVE AND LUBRICATING OIL COMPOSITION CONTAINING SAME

FIELD OF THE INVENTION

This invention relates to new anti-wear additives for lubricating compositions and to lubricating compositions containing these anti-wear additives.

Wear has always been a continuing problem associated with relatively moving parts. To effect a reduction in such wear, relatively moving parts have been lubricated by various means throughout recorded history. Various types of lubricants, such as animal fats, have been used. Later, compounded versions of naturally occurring fats and oils were used. Eventually, technology progressed to the point where today highly compounded mineral oil and synthetic oil based lubricants are available for lubricating relatively moving parts. However, even with these highly compounded lubricants which provide markedly reduced wear, the problem is far from being solved. Appreciable rates of wear still occur in almost any circumstance where relatively moving parts are found. High rates of wear occur in high output engines, such as diesel locomotives and ocean-going diesel engines, as well as in hydraulic systems.

SUMMARY OF THE INVENTION

An anti-wear additive for lubricating compositions comprises:

(A) 1 part by weight of a sulfurized acid prepared by sulfurizing an acid of the formula R-COOH wherein R is $C_{10-40}$ alkenyl, said sulfurized acid having a minimum sulfur content of 3% by weight and (B) 1-100 parts by weight of a phosphate of the formula

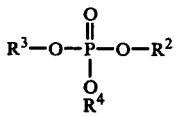

wherein each of $R^2$, $R^3$, and $R^4$ is independently a $C_6$-$C_{20}$ aromatic or $C_1$-$C_{20}$ aliphatic hydrocarbon group.

These new additives are particularly useful in lubricating oil or grease formulations.

DETAILED DESCRIPTION OF THE INVENTION

The Sulfurized Acid

The sulfurized acids used as one of the components of the additive composition of this invention are prepared by sulfurizing acids of the formula R-COOH, wherein R is $C_{10}$-$C_{40}$ alkenyl. By alkenyl is meant a straight- or branched-chain hydrocarbon group containing at least one site of olefinic unsaturation. Preferably R contains from 11 to 18 carbon atoms and, most preferably, from 16 to 18 carbon atoms. Oleic acid is particularly preferred. Undecylenic acid is also particularly preferred. The acids are sulfurized to contain at least 3% by weight sulfur, more preferably, at least 4% by weight sulfur, and most preferably, 5-15% by weight sulfur. The acids are sulfurized by contacting the unsaturated acid with elemental sulfur under nitrogen at a temperature of from about 140°-180° C., preferably 145°-160° C., until sulfurization is substantially completed, usually in about 15-25 hours.

Representative acids which can be sulfurized for use within the compositions of this invention include decylenic acid, undecylenic acid, dodecylenic acid, oleic acid, dimerized linoleic acid, linoleic acid, linolenic acid, eleostearic acid, parinaric acid, palmitoleic acid, petroselenic acid, vaccenic acid, erucic acid, etc.

THE PHOSPHATES

The phosphates used in the practice of this invention have the formula

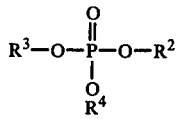

wherein each of $R^2$, $R^3$, and $R^4$ is independently a $C_6$-$C_{20}$ aromatic or $C_1$-$C_{20}$ aliphatic hydrocarbon group.

By aromatic is meant a group having a benzene or naphthalene ring which is optionally substituted by one or more alkyl groups. Typical aromatic groups contemplated for use within the scope of this invention are phenyl, xylyl, cresyl, naphthyl, and the like. Preferred aromatic groups contain from 6-15 carbon atoms.

The aliphatic hydrocarbon groups for use within the scope of this invention contain from 1-20 carbon atoms. By aliphatic is meant any straight- or branched-chain hydrocarbon group having one or two sites of olefinic unsaturation or one or two sites of acetylenic unsaturation. Preferred groups for use in this invention, however, are straight- or branched-chain alkyl groups. Preferred groups are ethyl, propyl, butyl, hexyl, 2-methylhexyl, 2-methylethyl, 2-methylheptyl, octyl, 2-ethyloctyl, decyl, dodecyl, and octadecyl. Particularly preferred are those alkyl groups having 1 to 8 carbon atoms.

As can be seen from the formula given, the phosphate esters may be ones in which the R groups are all aromatic or all aliphatic. Likewise, mixed aromatic-aliphatic phosphates are also possible. Representative mixed phosphates are, for example, dibutyl phenyl phosphate, diamyl cresyl phosphate, diphenyl cresyl phosphate, diphenyl isopropyl phosphate and the like.

The preferred phosphate for use in this invention is tricresyl phosphate.

The anti-wear additive of this invention comprises 1-100 parts by weight of a phosphate per part by weight of the sulfurized acid. Preferably the anti-wear additive contains from 5-25 parts by weight and most preferably from 7-15 parts by weight of the phosphate per part of the sulfurized acid.

THE LUBRICANT BASE

The anti-wear additive can be used in any relatively inert and stable oil of lubricating viscosity. Such lubricating oils generally have viscosities of 35-50,000 Saybolt Universal Seconds (SUS) at 100° F. The oil may be derived from either natural or synthetic sources. Included among the natural hydrocarbon oils are paraffin base, naphthenic base or mixed base oils. Synthetic oils include polymers of various olefins, generally from 2-6 carbon atoms alkylated aromatic hydrocarbons and so forth. Non-hydrocarbon oils include polyalkylene oxides, aromatic ethers, silicones, and so forth. The preferred media are the hydrocarbonaceous media, both natural and synthetic. Particularly preferred are those hydrocarbonaceous oils having a viscosity of about 100–4,000 SUS, and particularly those having viscosity from 200–2,000 SUS at 100° F. Greases comprise oils thickened by gellants or thickeners, such as lithium, sodium and calcium soaps, synthetic soap-like salt, non-carboxylic salts, polymers, or various inorganic compounds. The oils thickened include petroleum oils and polysiloxanes.

The anti-wear additives of this invention will be present in an amount from about 0.01–10% by weight in the final lubricant or grease composition. In concentrates, however, the anti-wear additive comprises from 10–80% by weight of the composition. The concentrates are prepared using any inert diluent. They usually have a lubricating oil as the inert carrier. Concentrates are prepared to minimize storage and carrier. Concentrates are prepared to minimize storage and transportation costs. When the concentrate is ready to be used, it is diluted with additional oil to give the desired concentration of anti-wear additive in the lubricant.

Other additives may also be present in the composition of this invention. Materials may be added to enhance the extreme pressure effects of the additives or give some other desirable properties to the lubricating medium. These include such additives as rust and corrosion inhibitors, antioxidants, oiliness agents, detergents, foam inhibitors, viscosity index improvers, pour point depressants, and so forth. Usually these additives will be in the range of about 0–5% by weight, more generally in the range from about 0–2% by weight of the total composition. The weight percentages of these additional additives if in a lubricating oil concentrate would be correspondingly higher.

The following examples illustrate the practice of this invention.

EXAMPLE 1

281 grams oleic acid and 32 grams sulfur were stirred under nitrogen at 154°–162° C. for 20 hours then stripped under a vacuum of about 500 mm mercury and a temperature up to 160° C. bottom. The product weighed 311 grams and contained 9.8% sulfur.

EXAMPLE 2

422 grams oleic acid and 24 grams sulfur were stirred under nitrogen at 154°–160° C. for 19 hours. The reaction mixture was stripped under vacuum of about 500 mm mercury to a temperature of 160° C. bottom. The product was filtered through diatomaceous earth and after filtering weighed 420 grams and contained 5.22% sulfur.

Examples 1 and 2 illustrate means of sulfurizing unsaturated acids. It would be readily apparent to one skilled in the art that any unsaturated acid could be similarly sulfurized.

EXAMPLE 3

The additives of this invention were tested for anti-wear properties under boundary lubrication conditions by means of the well-known 4-Ball Wear Test in which three one-half-inch-diameter steel balls are clamped together and immersed in the test lubricant. A fourth ball is then rotated at about 1800 rpm in contact with the other three balls. A 40-kilogram load is applied, forcing the rotating ball against the three stationary balls. The test is run for 1 hour at 75° C. The sizes of the wear scars on the three stationary balls are measured and the average scar size in millimeters reported. The smaller the scar, the greater the anti-wear properties of the test lubricant. Table I below reports the results of the 4-Ball Wear Test with the additives of this invention and also provides data for wear scars for lubricants containing no additive and for a phosphate or a sulfurized acid alone. The base formulation is a Citcon neutral oil containing 0.3% phenolic antioxidant. 0.15% aromatic amine antioxidant, 0.05% rust inhibitor and 0.05% metal deactivator.

The dramatic effect of the combination of phosphate and sulfurized olefinic acid is readily apparent from the data in the Table.

TABLE I

| | 4-Ball Wear Test | | |
|---|---|---|---|
| Sulfurized Acid % wt. | % Sulfur in Acid | Phosphate, wt. % | Scar, mm |
| — | — | — | 0.60 |
| — | — | 1% tricresyl phosphate | 1.83, 1.61 |
| — | — | 0.5% tricresyl phosphate | 1.98, 1.99 |
| 0.1% oleic acid | 10 | — | 0.71 |
| 0.1% oleic acid | 10 | 1% tricresyl phosphate | 0.43, 0.38, 0.45, 0.41 |
| 0.1% oleic acid | 7.5 | 1% tricresyl phosphate | 0.40 |
| 0.1% oleic acid | 5 | 1% tricresyl phosphate | 0.40, 0.34 |
| 0.1% oleic acid | 0 | 1% tricresyl phosphate | 1.89 |
| 0.05% oleic acid | 10 | 1% tricresyl phosphate | 0.43 |
| 0.02% oleic acid | 10 | 1% tricresyl phosphate | 0.45 |
| 0.1% undecylenic acid | 12 | 1% tricresyl phosphate | 0.38 |
| 0.1% dimerized linoleic acid | 2.5 | 1% tricresyl phosphate | 0.47 |
| 0.1% oleic acid | 5 | 0.5% tricresyl phosphate | 0.42 |
| 0.1% oleic acid | 10 | 0.5% tricresyl phosphate | 0.39, 0.41 |
| 0.1% oleic acid | 10 | 0.75% tricresyl phosphate | 0.37 |
| 0.1% oleic acid | 10 | 1% trixylyl phosphate | 0.42 |
| 0.1% oleic acid | 10 | 1% cresyl diphenyl phosphate | 0.48, 0.44 |
| 0.1% oleic acid | 10 | 1% isopropyl diphenyl phosphate | 0.42 |

What is claimed is:

1. An anti-wear additive for lubricating compositions comprising (A) 1 part by weight of a sulfurized acid prepared by sulfurizing an acid of the formula R-COOH wherein R is $C_{10}$–$C_{40}$ alkenyl, said sulfurized acid having a minimum sulfur content of 3% by weight and (B) 1–100 parts by weight of a phosphate of the formula

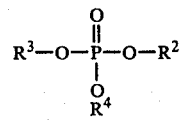

wherein each of $R^2$, $R^3$, and $R^4$ is independently a $C_6$–$C_{20}$ aromatic or $C_1$–$C_{20}$ aliphatic hydrocarbon group.

2. The antiwear additive of claim 1 comprising 1 part by weight of sulfurized acid and 5–25 parts by weight of phosphate.

3. The additive of claim 2 wherein R is $C_{16}$–$C_{18}$ alkenyl, $R^2$ is phenyl, xylyl or cresyl, $R^3$ is phenyl, xylyl, cresyl, or isopropyl, and $R^4$ is xylyl, cresyl, or isopropyl, and component (A) has a minimum sulfur content of 5% by weight.

4. A lubricating composition comprising a lubricating oil or grease and from 0.01% to 10% by weight of the anti-wear composition of claim 1.

5. The lubricating composition of claim 4 containing 0.05% to 2% by weight of said anti-wear composition wherein R is $C_{12}$–$C_{18}$ alkenyl, each of $R^2$, $R^3$, and $R^4$ is independently a $C_6$–$C_{15}$ aromatic or a $C_1$–$C_8$ alkyl group.

6. The lubricating composition of claim 5 containing 0.1% to 1% by weight of said anti-wear composition wherein R is $C_{18}$ alkenyl, each of $R^2$, $R^3$, and $R^4$ is cresyl, component (A) has a sulfur content of 5–15% by weight, and there are from 7 to 15 parts by weight (B) for each part by weight (A).

7. The lubricating composition of claim 6 wherein (A) sulfurized oleic acid.

8. The lubricating composition of claim 2 wherein (A) is sulfurized undecylenic acid.

9. A lubricating oil concentrate comprising a lubricating oil and from 10% to 80% by weight of the anti-wear composition of claim 1.

10. The lubricating oil concentrate of claim 9 wherein R is $C_{12}$–$C_{18}$ alkenyl, each of $R^2$, $R^3$, and $R^4$ is independently a $C_6$–$C_{15}$ aromatic or a $C_1$–$C_8$ alkyl group, component (A) has a sulfur content of 5–15% by weight and there are from 7 to 15 parts by weight (B) for each part by weight (A).

11. The lubricating oil concentrate of claim 10 wherein (A) is sulfurized oleic acid.

* * * * *